US006058948A

United States Patent [19]

Wershe

[11] Patent Number: 6,058,948

[45] Date of Patent: May 9, 2000

[54] BEARING CLEANING SYSTEM

[76] Inventor: Richard Wershe, 28020 Elba, St. Clair Shores, Mich. 48081

[21] Appl. No.: 09/035,505

[22] Filed: Mar. 5, 1998

Related U.S. Application Data

[63] Continuation-in-part of application No. 08/890,348, Jul. 9, 1997.

[51] Int. Cl.[7] ..... B08B 3/04

[52] U.S. Cl. ..... 134/117; 134/182

[58] Field of Search ..... 134/116, 117, 134/182, 183; 206/205, 5.1

[56] References Cited

U.S. PATENT DOCUMENTS

| | | | |
|---|---|---|---|
| 2,652,843 | 9/1953 | Schuchman et al. | 134/116 |
| 2,823,682 | 2/1958 | Coulter | 134/116 X |
| 4,697,697 | 10/1987 | Graham et al. | 206/205 X |
| 4,782,941 | 11/1988 | Freise | 134/117 X |
| 5,678,582 | 10/1997 | McClure | 134/116 |

FOREIGN PATENT DOCUMENTS

| | | | |
|---|---|---|---|
| 714385 | 7/1965 | Canada | 206/205 |
| 511595 | 10/1971 | Switzerland | 134/117 |

*Primary Examiner*—Philip R. Coe

*Attorney, Agent, or Firm*—Reising, Ethington Barnes, Kisselle, Learman & McCulloch, P.C.

[57] ABSTRACT

A bearing cleaning apparatus contains a cage assembly (14), bottle (10), and cap (12). The cage assembly (14) includes rectangular-shaped vertical side arms (16) which define one or more channels (26) in which one or more circular bearings (20) may be placed. The cage assembly (14) contains perforations (28) to facilitate solvent flow through the bearings (20) and through the cage assembly (14). The cage assembly (14) also includes shoulders (30) at the bottom of the assembly (14), a closure mechanism (22) at the top of the assembly (14), and flanges (44) in order to prevent the bearings (20) from exiting the cage assembly (14) during cleaning.

10 Claims, 6 Drawing Sheets

BEARING CLEANING SYSTEM

This is a continuation-in-part of and priority is claimed to co-pending U.S. Ser. No. 08/890,348 filed on Jul. 9, 1997.

TECHNICAL FIELD

This invention relates to bearing cleaning systems and, more particularly, to portable manually-operated bearing cleaning systems that are capable of cleaning one or more circular bearings with a solvent in an enclosed container.

BACKGROUND OF THE INVENTION

In-line skating has become an extremely popular sport in the United States and elsewhere. As the popularity of the sport has increased, demand for accessories for repairing and maintaining in-line skates has also increased. One common problem associated with frequent use of in-line skates is that dirt and other contaminants often get into the wheel bearings, leading to a decline in the overall performance of the wheels and ultimately the skates. Many in-line skaters prefer to take apart their skates and clean the wheel bearings themselves. This can be a time-consuming and cumbersome process, however.

Many in-line skating enthusiasts desire a portable system by which they can quickly clean the bearings on their in-line skates so as to prevent damage to the bearings and increase the overall performance of their in-line skate.

SUMMARY OF THE DISCLOSURE

The present invention is a bearing cleaning apparatus including a bearing retaining assembly and a sealable container adapted to receive the retaining assembly. The container includes an interior cavity sized to hold the retaining assembly within a solvent to clean the bearings held by the bearing retaining assembly.

In one embodiment of the invention, the retaining assembly comprises a cage assembly designed to hold several bearings in a stacked arrangement. The cage assembly includes two identically-shaped vertical side arms. Each side arm has a base wall and two side walls perpendicular to the base wall to form a channel into which the bearings can be placed. Each side wall has a top flange to retain the bearings inside the channel. The side arms contain perforations at the expected locations of the bearings so that solvent can easily pass through the cage assembly during cleaning. The bottom of each side arm includes a shoulder which is used to prevent the bearing assemblies from sliding through the bottom of the cage assembly.

The side arms are connected to each other by several spaced-apart cross supports. The cross supports include male and female parts which engage to join the side arms together. In some embodiments of the invention, the cross supports are snap-fitted together.

The side arms each include an elongated vertical projection in the shape of a half-cylinder. When the side arms are joined, the projections meet to form a pole. After cleaning, the bearings can be placed on the pole and spun to be dried. The pole is located at the top of the side arms.

A selectively engageable closure mechanism is mounted on the pole and is used to prevent the bearings from exiting the top of the cage assembly during cleaning. In one embodiment of the invention, the closure mechanism includes a rotatable bar which can turn to either an opened or a closed position. The bar includes an opening which enables it to be snap fit over the pole, and the bar rotates within a groove at the base of the pole.

The sealable container comprises a bottle and cap in one embodiment of the invention. The bottle is slightly taller than the cage assembly and includes an opening slightly wider than the width of the cage assembly. In alternate embodiments of the invention, the cage assembly can be either fixedly or removably attached to either the bottom of the bottle or the underside of the bottle cap.

In other embodiments of the invention, the retaining assembly includes an elongated member having a series of support arms extending therefrom. Each support arm includes at least two resilient fingers adapted to receive and hold a bearing. Alternatively, the retaining assembly can include an elongated member including a series of circular recesses adapted to receive and hold a bearing.

The retaining assembly can also comprise a series of trays adapted to hold a plurality of bearings. Each tray includes upper and lower plates which sandwich bearings placed sideways between the plates. The trays are separated by vertical spacer members which can be integrally joined to the trays or removable therefrom.

The method for cleaning bearings in the assembly is as follows. First, the dirty bearings are securely placed in the retaining assembly. After the container is filled with an appropriate type and amount of commercially available cleaning solvent, the retaining assembly is placed inside the container. The container is then sealed to prevent the solvent from leaking from the container.

Once the container is tightly closed, the user turns the container horizontal and thoroughly shakes the container for an appropriate amount of time. This motion causes the solvent to flow through the bearings inside the retaining assembly, loosening and removing dirt and other particles from the bearings. When the bottle has been thoroughly shaken, the retaining assembly is removed from the bottle and the bearings are allowed to dry.

In another embodiment, an elongated member can be placed across the container opening. After the bearings have been cleaned, the retaining assembly is placed atop the elongated member allowing the solvent to drain from the bearings and retaining assembly back into the container. After the solvent has drained from the bearings, bearings are removed from the retaining assembly.

Although the retaining assembly in the present invention is designed to hold circular bearings, it can be modified to hold other objects for cleaning such as slot car motors. For a slot car motor, an alternative embodiment of the retaining assembly includes a support member having an arm extending outwardly therefrom. The arm includes at least one hole adapted to receive a first end of the motor. An adjustable bracket is provided including a base releasably joined to the support member and a platform extending outwardly from the support member. The platform includes a recess adapted to receive a second end of the motor.

BRIEF DESCRIPTION OF THE DRAWINGS

Reference now is made to the accompanying drawings in which.

DETAILED DESCRIPTION OF THE INVENTION

Referring to FIGS. 1–7, the present invention relates to a portable apparatus for cleaning one or more bearings in a solvent. The invention includes a retaining assembly 14 adapted to hold one or more bearings 20, and a sealable container 10,12 having an interior cavity sized to receive the retaining assembly 14. The container 10,12 holds the retaining assembly 14 in place while the bearings 20 are cleaned by the solvent during agitation of the container 10,12.

Figure 1:
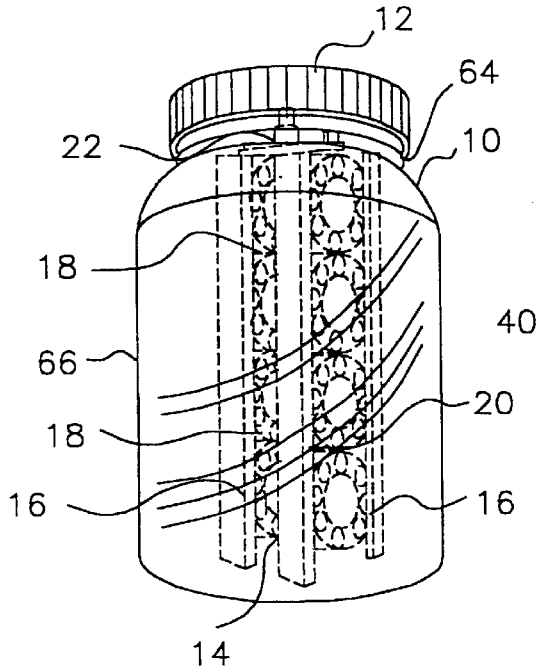
FIG. 1 is a perspective view of a bearing cleaning system including a first embodiment of the retaining assembly with bearings in place.

FIG. 1 illustrates a first embodiment of the invention in which the container 10,12 comprises a bottle 10 and a cap 12. The retaining assembly 14 comprises an elongated cage assembly 14 shown best in FIGS. 1, 4, and 5. In the first embodiment, the cage assembly 14 is independent of both the bottle 10 and bottle cap 12 and has a height approximately equal to the distance between the bottom of the bottle 10 and the cap 12 to prevent axial displacement during the cleaning process as later described. The cage assembly 14 can also be fixedly connected to the base of the bottle 10 or fixedly connected to the bottle cap 12 if desired.

Figure 4:
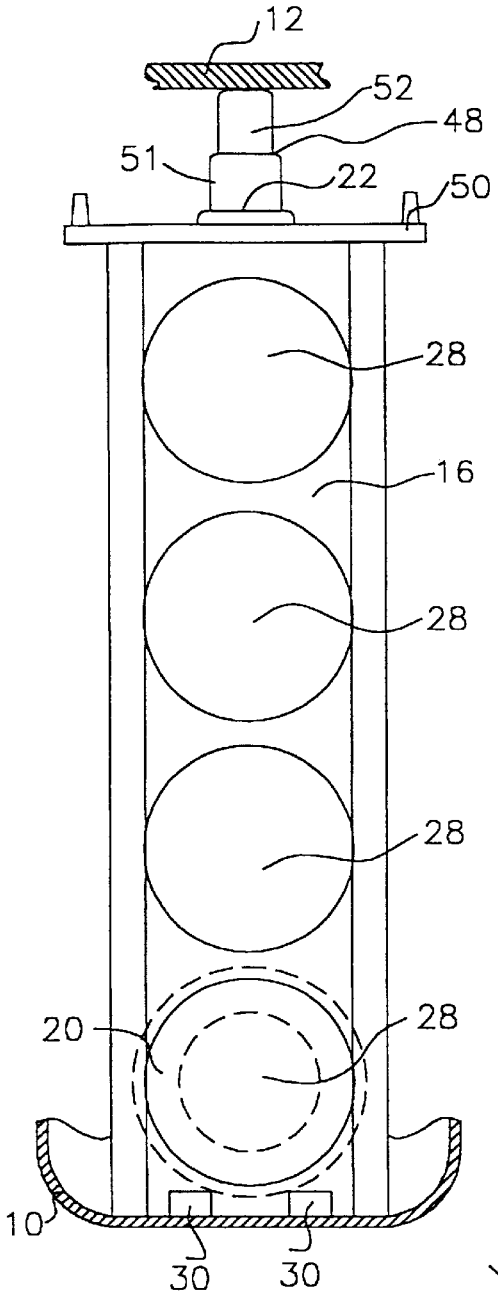
FIG. 4 is a front view of the retaining assembly of FIG. 1 with one bearing shown in phantom.
Figure 5:
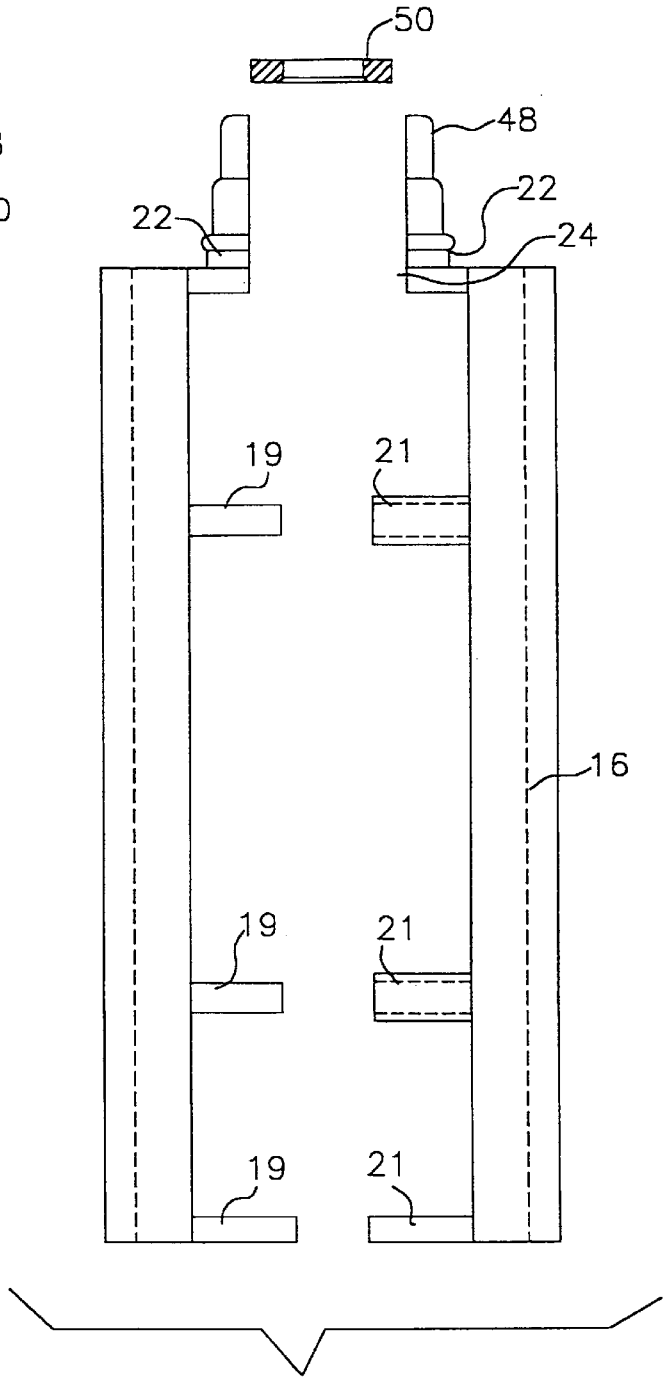
FIG. 5 is an exploded side view of the retaining assembly of FIG. 4 in which the cross supports are clearly shown.

As shown in FIGS. 1 and 5, the cage assembly 14 has two identical side arms 16 and multiple cross members 18 connecting the side arms 16 together. Each cross member 18 is formed by joining a male component 19 and a female component 21 on the respective identical side arms 16, as shown in FIG. 5. FIG. 4 illustrates that each side arm 16 has a flat surface with multiple perforations 28 to facilitate solvent flow through the cage assembly 14.

Figure 2:
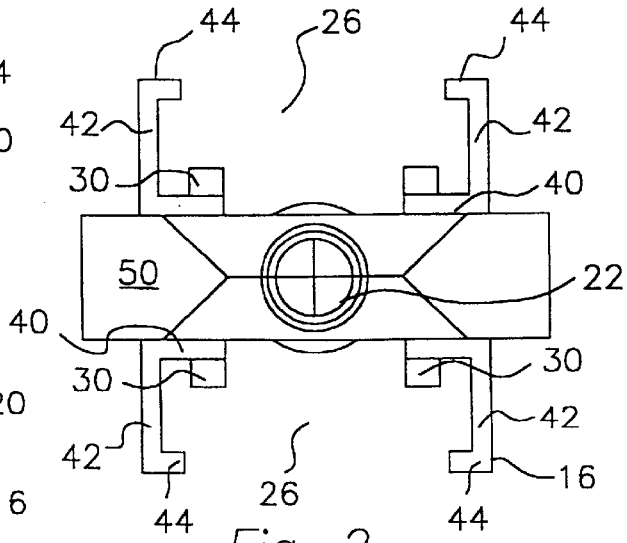
FIG. 2 is a top plan view of the retaining assembly of FIG. 1 with the closure mechanism shown in the open position.
Figure 3:
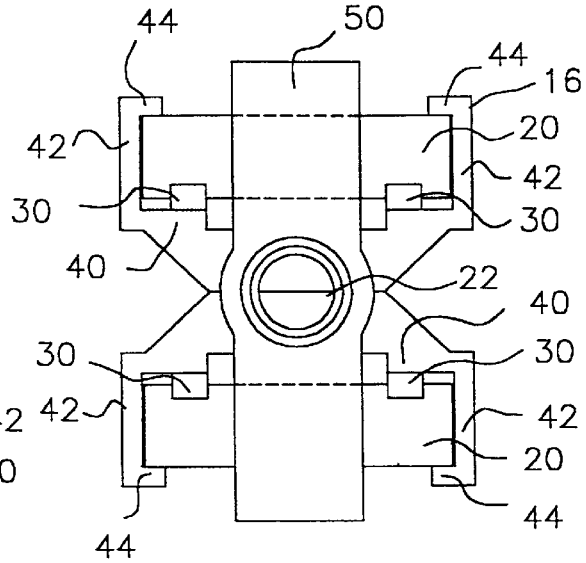
FIG. 3 is a top plan view of the retaining assembly of FIG. 1 with the closure mechanism shown in the closed position.
Figure 7:
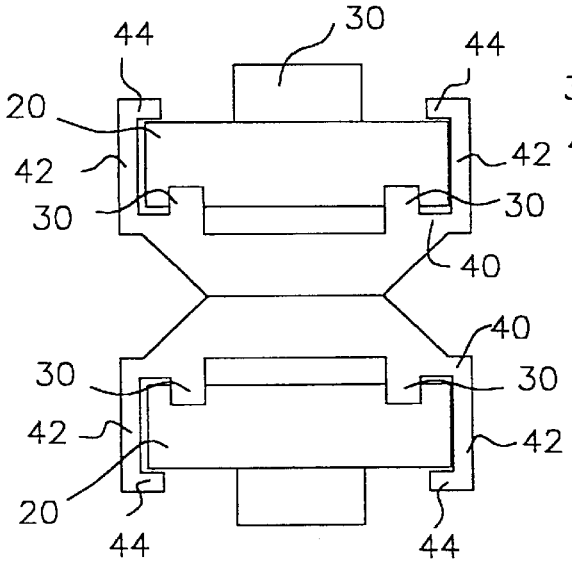
FIG. 7 is a bottom end view of the retaining assembly of FIG. 4 with the closure mechanism in the closed position.

As shown in FIGS. 2, 3 and 7, the side arms 16 each have a base wall 40 and opposing side walls 42 joined to the base wall 40 in a perpendicular arrangement. The distal end of each side wall 42 includes an inwardly extending flange 44 to define a channel 26 for receiving and holding the bearings 20 within the cage assembly 14.

As shown in FIG. 5, mating half cylinders are disposed at the top of each side arm 16 which join together to form a pole 48. The pole 48 includes a wide base 49 followed by a section of decreasing diameter 51 in a telescoping arrangement such that bearings 20 can be placed on the pole 48 and spun to be dried.

FIG. 7 illustrates that the lower ends of the side arms 16 contain shoulders 30 which prevent the bearings 20 from sliding through the bottom of the channel 26 and, hence, the bottom of the cage assembly 14. In an alternate embodiment of the invention, the channels 26 are slightly smaller than the bearings 20 but are resilient to hold the bearings in place without sliding within the channels 26. In such an embodiment, the shoulders 30 would be unnecessary.

Figure 6:
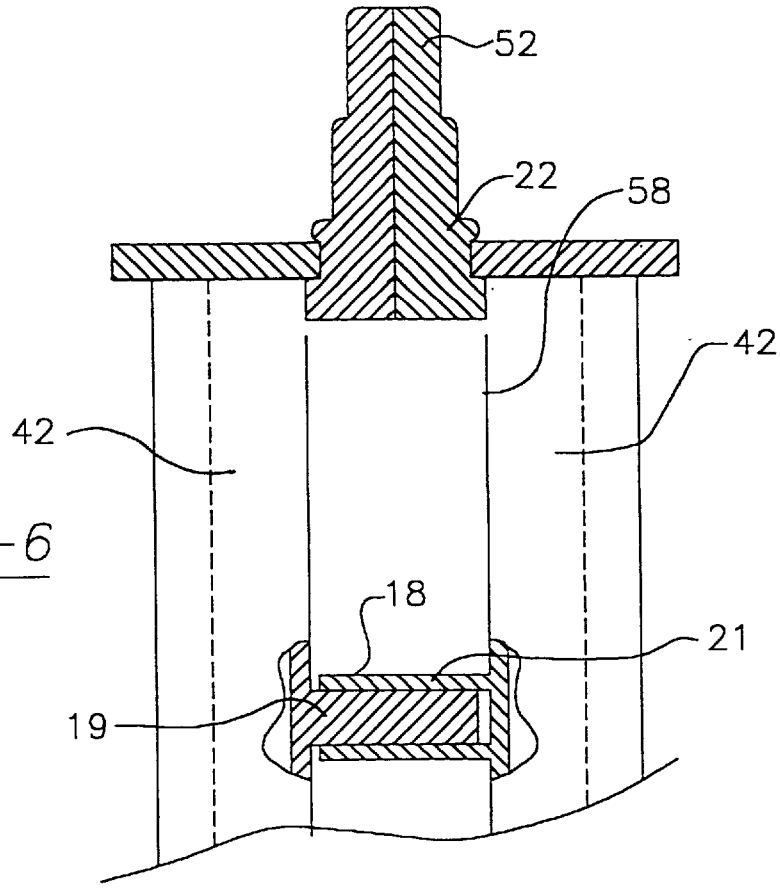
FIG. 6 is a fragmentary side view of the upper portion of the retaining assembly of FIG. 4 with the closure mechanism shown in the closed position.

A selectively engageable closure mechanism 22 is mounted on the pole 48 to prevent the bearings 20 from exiting the top of the channel 26 in the cage assembly 14 during cleaning, as shown in FIGS. 2 and 3. The closure mechanism 22 comprises a straight bar 50 with a central opening 52 which, as shown in FIG. 6, allows the bar 50 to be snap-fitted over the pole 48. The bar 50 is capable of rotating between the positions shown in FIGS. 2 and 3 such the cage assembly 14 can be opened and closed by the user.

The operation of the invention is straightforward and simple. Before cleaning, the closure mechanism 22 is in the open position shown in FIG. 2 to allow the cage assembly 14 to receive the circular bearings 20. One or more circular bearings 20 are then placed into the channels 26. After the closure mechanism 22 is turned to prevent removal of the bearings 20 from the channel 26, the cage assembly 14 is placed into the bottle 10. Solvent is poured into the bottle 10 either before or after the cage assembly 14 is placed inside the bottle 10.

If desired, the bearings 20 can be completely submersed in solvent and allowed to soak. Solvent can then be poured out of the bottle 10 such that about one third of the bottle is filled with solvent in order to allow the solvent adequate room to vigorously circulate in the bottle 10 during agitation. The cap 12 is then used to seal the bottle 10. The bottle 10 is then disposed horizontally, after which the user thoroughly shakes the bottle 10 in a vertical direction. Solvent will be directed back and forth through the holes 28 providing access to the bearings 20 to remove unwanted particles from the bearings 20.

After cleaning the bearings 20, the cap 12 is removed from the bottle 10 and the bearings 20 are dried in the ambient air after the cage assembly 14 is removed from the bottle 10. In an alternate embodiment of the invention, an elongated flat bar (not shown) can be placed across the opening of the bottle 10. The cage assembly 14 is placed atop the elongated flat bar and is supported thereon during drying. Alternatively, the flat bar can extend between the side arms and abut a pair of the cross supports 18. Once the solvent has drained from the bearings 20 and cage assembly 14 into the bottle 10, the closure mechanism 22 is turned or rotated such that the bearings 20 may be removed from the cage assembly 14.

Figure 8:
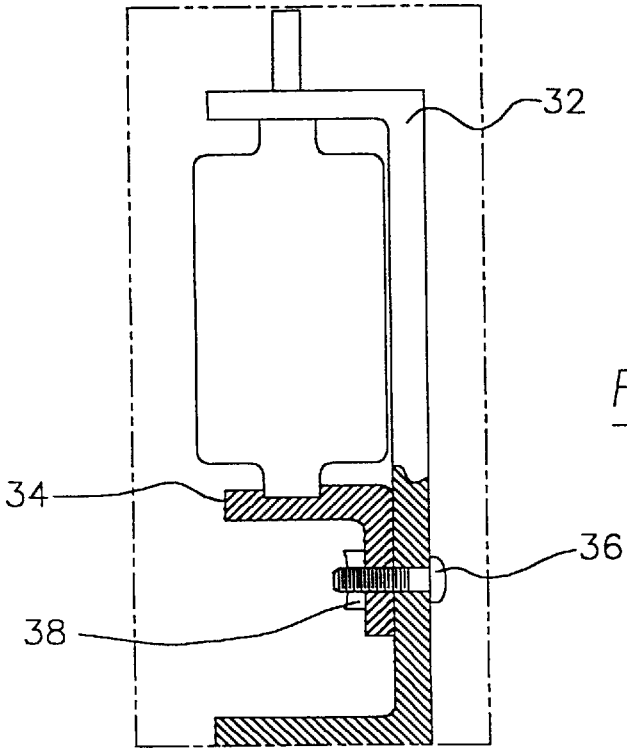
FIG. 8 is a side view of a second embodiment of the retaining assembly designed to hold a slot car motor for cleaning.

In a second embodiment of the invention shown in FIG. 8, the cage assembly 14 includes a support member 32 and an adjustable bracket 34 including a horizontal platform 35. The support member 32 includes an arm 37 at an upper end thereof including at least one hole adapted to receive a first end 41 of a slot car motor 39. The platform 35 includes a recess 43 adapted to receive a second end 45 of the slot car motor 39. The bracket 34 is joined to the support member 32 with a bolt 36 and wing nut 38.

Figure 10:
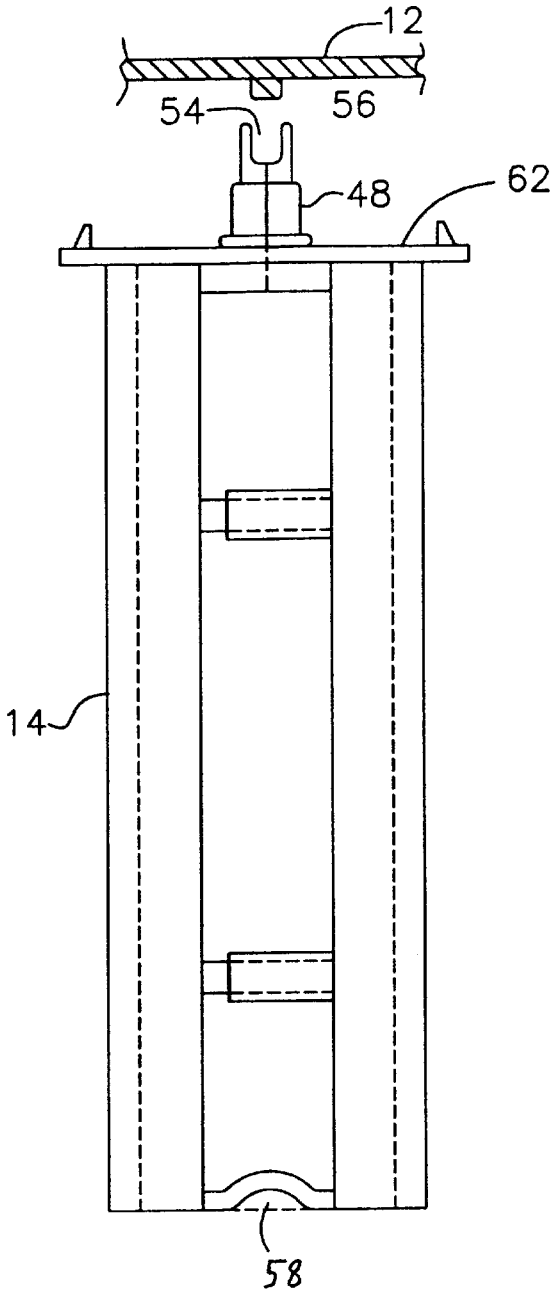
FIG. 10 is a side view of the third embodiment of the retaining assembly of FIG. 9.
Figure 9:
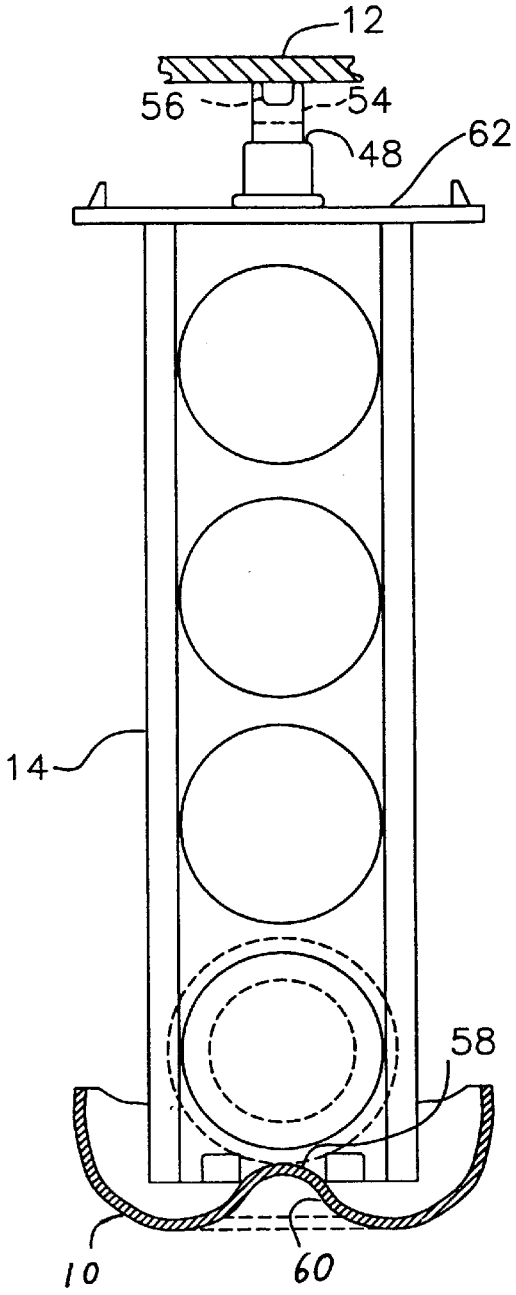
FIG. 9 is a front view of a third embodiment of the retaining assembly including recesses adapted to engage projections on the bottle and cap.

Further modifications can be made to the cage assembly 14 to securely retain the cage 14 within the bottle 10. As shown in FIG. 9, a third embodiment of the invention is shown in which the pole 48 includes a notch 54 adapted to receive a nub 56 in the center of the bottom surface of the cap 12. Further, as shown in FIGS. 9 and 10, the bottom of the cage assembly 14 includes a recess 58 adapted to receive a raised area 60 on a bottom surface of the bottle 10. The nub 56 and raised area 60 will serve to center the cage 14 within the bottle 10 and ensure that all sides of the cage 14 are equally exposed to circulating solvent during cleaning of the bearings 20.

In the third embodiment, the closure mechanism 62 comprises a circular flange having a diameter only slightly smaller than the internal diameter of the bottle 10. Thus, as the cage assembly 14 is inserted into the bottle 10, the flange 62 will also help center the cage assembly 14 within the bottle 10 and prevent lateral displacement within the bottle 10. In bottles 10 of the type shown in FIG. 1 having a neck 64 of a smaller diameter than the body 66 of the bottle, the circular flange 62 will include a diameter small enough to fit within the neck 64 of the bottle as opposed to slightly smaller than the inner diameter of the bottle 10.

Figure 11:
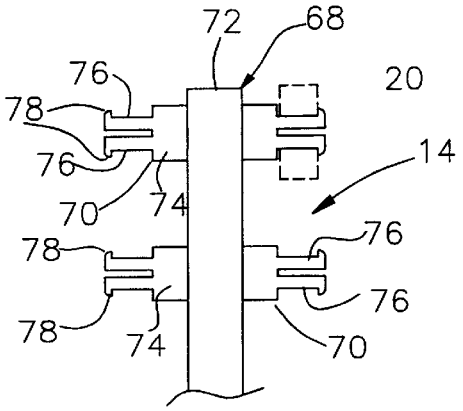
FIG. 11 is a side view of a fourth embodiment of the retaining assembly including support arms having resilient fingers adapted to hold a bearing.
Figure 12:
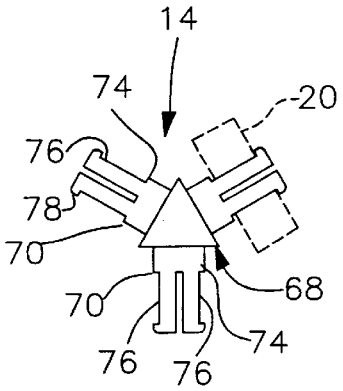
FIG. 12 is a top view of the fourth embodiment of the retaining assembly of FIG. 11.

FIGS. 11 and 12 illustrate a fourth embodiment of the invention in which the retaining assembly 14 comprises a rack 68 including a plurality of retaining arms 70 extending perpendicularly from a central support 72. Each retaining arm 70 includes a base 74 which supports a pair of resilient fingers 76 in a spaced apart relation. Each resilient finger 76 includes a nub 78 extending perpendicular to the finger 76 on an outwardly facing surface thereof.

The rack 68 can retain one bearing 20 on each retaining arm 70. Specifically, the bearings 20 are pushed onto the retaining arms 70 such that the resilient fingers 76 slip within the central bore of each bearing 20. The nubs 78 will cause the resilient fingers 76 to compress together as the bearing 20 is slid thereon. After a bearing 20 is pushed sufficiently far onto the retaining arm 70, the nubs 78 will emerge from the central bore of the bearing 20 and the resilient fingers 76 will spring outwardly to their starting position. The nubs 78 will resist removal of the bearing 20 from the retaining arm 70 during normal shaking of the bottle 10 with the solvent. A sufficient manual pulling force exerted on the bearing 20 will pull it off of the retaining arm 70.

As shown in FIG. 12, the central support 72 preferably has a triangular cross-section such that a retaining arm 70 may be disposed in three different orientations along the length of the central support 72. Alternatively, the central support 72 can include a rectangular cross-section as shown in FIG. 11 or other multi-sided shape wherein each side would support one or more retaining arms 70 along the length thereof.

Figure 13:
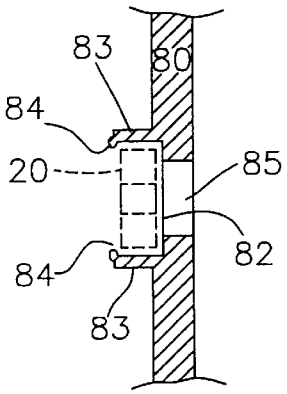
FIG. 13 is a side view of a fifth embodiment of the retaining assembly including circular recesses adapted to hold a bearing.

FIG. 13 illustrates a fifth embodiment of the retaining assembly 14 comprising a post 80 including a series of circular recesses 82 disposed along the length thereof. Each recess 82 is circular and has a diameter slightly larger than the outer diameter of a bearing 20 and a depth approximately equal to the thickness of a bearing 20. Further, each recess 82 includes a resilient arced wall 83 with a distal ridge 84 extending slightly inwardly. After a bearing 20 is pressed within the recess 82 and fully received therein, the circular ridge 84 will slightly overlap the bearing 20 and retain the bearing 20 during the shaking of the bottle for cleaning purposes. Aperture 85 on the back side of post 80 allows solvent to pass therethrough to the bearing but prevents bearing 20 from passing therethrough. Arced wall 83 and ridge 84 may be completely circular or be a plurality of partially circular arcs disposed about the periphery of the recess 82. The post 80 can comprise any shape including triangular, rectangular, or other multi-sided shape. One can easily remove the bearing by poking a finger through aperture 85 and pushing against the bearing 20.

Figure 14:
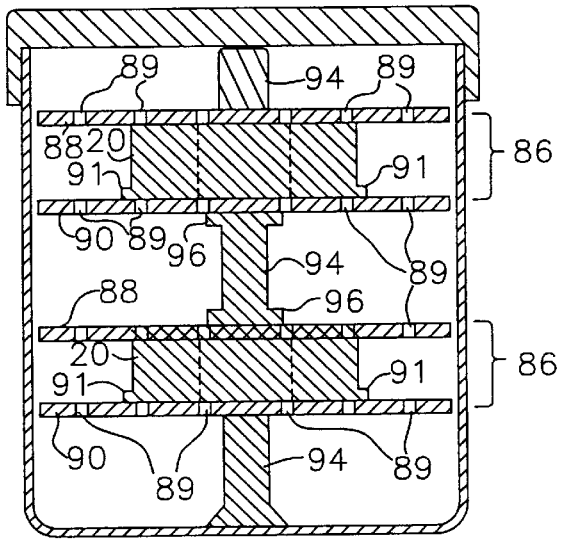
FIG. 14 is a side cross sectional view of the bearing cleaning system including a sixth embodiment of the retaining assembly incorporating a plurality of circular trays for holding bearings.
Figure 15:
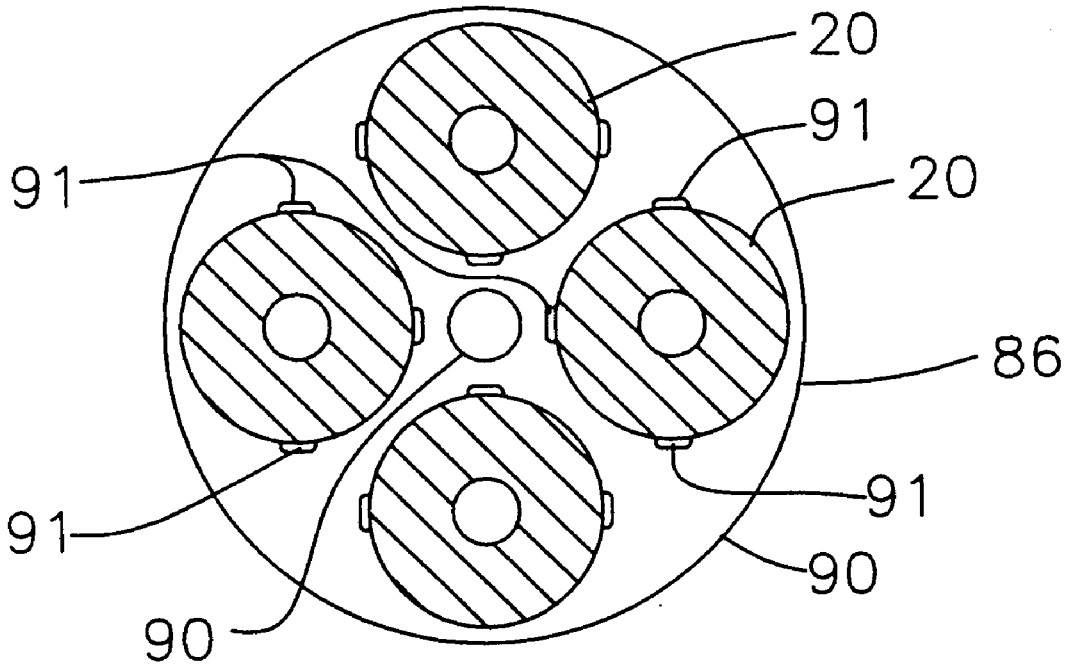
FIG. 15 is a top cross sectional view of the bearing cleaning system of FIG. 14.

FIGS. 14 and 15 illustrate a sixth embodiment of the invention in which the retaining assembly 14 comprises a series of circular trays 86 which are adapted to hold a plurality of bearings 20. Each tray 86 has an outer diameter slightly smaller than the inner diameter of the bottle 10 and includes an upper and lower plate 88,90 spaced sufficiently apart to accommodate the thickness of a bearing 20. Each plate 88 and 90 have a plurality of apertures or perforations 89 to allow the flow of solvent therethrough. As shown in the top view of FIG. 15, each tray 86 can be adapted to contain four or more bearings 20.

Each tray 86 includes a central support 90 (shown in FIG. 15) which maintains the spacing between the upper and lower plates 88,90. Further, the trays 86 are vertically spaced from one another by a series of spacer members 94. As shown in FIG. 14, some or all of the spacer members 94 can include flanges 96 for supporting the trays 86. The spacer members 94 can be integrally joined with the trays 86 or can be separate components. In addition to separating the trays 86, the spacer members 94 also separate the trays 86 from the bottom of the bottle 10 and from the cap 12.

During use, bearings 20 are inserted between the upper and lower plates 88,90 of the trays 86 to the maximum capacity of each tray 86. Each tray may optionally have nubs 91 to snap fit the bearing securely in place. Next, the trays 86 are stacked together using the spacer members as discussed above. Finally, the entire assembly is inserted within the bottle and the bearings are cleaned by shaking of the bottle partially filled with solvent.

Other variations and modifications are possible without departing from the scope and spirit of the present invention as defined by the appended claims.

The embodiments in which an exclusive property or privilege is claimed are defined as follows:

1. A portable apparatus for cleaning one or more bearings in a solvent, said apparatus comprising:

a retaining assembly adapted to hold one or more bearings; and a sealable container having an interior cavity sized to received said retaining assembly whereby container holds said retaining assembly in place while the bearings are cleaned by the solvent during agitation of said container;

said sealable container having an exterior dimension sized to be manually agitated by a user;

said retaining assembly comprises an elongated member including at least one support arm extending outwardly therefrom and adapted to receive a bearing of the type having a central opening; and said support arm including an outwardly extending projection adapted to resist removal of the bearing from said support arm.

2. The apparatus as defined in claim 1 wherein said support arm includes a plurality of resilient fingers adapted to receive the bearing and each of said fingers includes an outwardly extending projection.

3. The apparatus as defined in claim 2 wherein said elongated member has three sides and each of said sides includes at least one support arm extending outwardly therefrom.

4. A portable apparatus for cleaning one more bearings in a solvent, said apparatus comprising:

a retaining assembly adapted to hold one or more bearings; and a sealable container having an interior cavity sized to receive said retaining assembly whereby said container holds said retaining assembly in place while the bearings are cleaned by the solvent during agitation of said container;

said sealable container having an exterior dimension sized to be manually agitated by a user;

said retaining assembly comprises an elongated member including at least one wall adapted to engage the outer periphery of a circular bearing; and a projection extending radially inwardly from said wall and adapted to resist disengagement of the bearing.

5. A portable apparatus for cleaning one or more bearings in a solvent, said apparatus comprising:

a retaining assembly adapted to hold one or more bearings; and a sealable container having an interior cavity sized to receive said retaining assembly whereby said container holds said retaining assembly in place while the bearings are cleaned by the solvent during agitation of said container;

said sealable container having an exterior dimension sized to be manually agitated by a user;

said retaining assembly comprises at least one tray including upper and lower plates which are spaced apart and adapted to receive at least one bearing placed therebetween.

6. The apparatus as defined in claim 5 wherein:

said spacing between said plates is selected to accommodate the thickness of a bearing to be inserted therebetween;

said bottom plate is supported on a rod which is adapted to maintain the tray in a raised position; and said plates include perforations therethrough to facilitate solvent flow through the bearings and through said retaining assembly.

7. The apparatus as defined in claim 6 further comprising at least two trays disposed in a vertically stacked arrangement wherein the uppermost tray includes an upwardly extending projection.

8. A portable apparatus for cleaning one or more bearings in a solvent, said apparatus comprising:

a retaining assembly adapted to hold one or more bearings; and a sealable container having an interior cavity sized to received said retaining assembly whereby said container holds said retaining assembly in place while the bearings are cleaned by the solvent during agitation of said container;

said sealable container having an exterior dimension sized to be manually agitated by a user;

said retaining assembly includes a recess adapted to receive a projection disposed in the center of a bottom surface of said container.

9. A portable apparatus for cleaning one or more bearings in a solvent, said apparatus comprising:

a retaining assembly hold one or more bearings;

a sealable container having air interior cavity sized to receive said retaining assembly whereby said container holds said retaining assembly in place while the bearings are cleaned by the solvent during agitation of said container; and a removable cap adapted to seal said container;

said sealable container having an exterior dimension sized to be manually agitated by a user;

said retaining assembly includes an upwardly extending shaft having a recess adapted to receive a nub on an underside of said cap.

10. A portable apparatus for cleaning one or more bearings in solvent, said apparatus comprising:

a retaining assembly adapted to hold one or more bearings; and a sealable container having an interior cavity sized to receive said retaining assembly whereby said container holds said retaining assembly in place while the bearings are cleaned by the solvent during agitation of said container;

said sealable container having an exterior dimension sized to be manually agitated by a user;

said retaining assembly includes a flange extending outwardly therefrom and having an outer periphery substantially corresponding to the shape of the interior cavity of the container and adapted to restrict lateral movement of said retaining assembly within said container.

* * * * *

UNITED STATES PATENT AND TRADEMARK OFFICE

CERTIFICATE OF CORRECTION

PATENT NO. : 6,058,948
DATED : May 9, 2000
INVENTOR(S) : Richard Wershe

It is certified that error appears in the above-identified patent and that said Letters Patent is hereby corrected as shown below:

Column 6, line 45 of Patent; after "to" delete "received" and insert therein

--receive--.

Column 6, line 45 of Patent; after "whereby" add --said--.

Column 8, line 4, of Patent; after "to" delete "received" and insert therein

--receive--.

Column 8, line 15, of Patent; after "assembly" insert --adapted to--.

Column 8, line 16, of Patent; after "having" delete "air" and insert therein --an--.

Column 8, line 29, of Patent; after "in" insert --a--.

Signed and Sealed this

Tenth Day of April, 2001

*Attest:*

Nicholas P. Godici

NICHOLAS P. GODICI

*Attesting Officer*

*Acting Director of the United States Patent and Trademark Office*